United States Patent [19]

Castagnoli

[11] Patent Number: 4,588,212

[45] Date of Patent: May 13, 1986

[54] DOCUMENT OF VALUE

[75] Inventor: Rinaldo Castagnoli, Lausanne, Switzerland

[73] Assignee: De la Rue Giori S.A., Switzerland

[21] Appl. No.: 645,268

[22] Filed: Aug. 29, 1984

[30] Foreign Application Priority Data

Nov. 16, 1983 [CH] Switzerland ..... 6149/83

[51] Int. Cl.[4] ..... B42D 15/02; B44F 1/10

[52] U.S. Cl. ..... 283/91; 283/72; 283/57; 428/29; 428/156; 428/916; 40/453

[58] Field of Search ..... 283/70, 72, 74, 75, 283/85, 91, 113, 57, 902; 427/7, 145; 428/29, 30, 915, 916; 40/452, 453; 101/712, 150, 713, 151; 273/1 R, 243

[56] References Cited

U.S. PATENT DOCUMENTS 4,033,059 7/1977 Hutton et al. ..... 101/150 X

*Primary Examiner*—Robert L. Spruill
*Assistant Examiner*—Mark Prado
*Attorney, Agent, or Firm*—Kane, Dalsimer, Kane, Sullivan and Kurucz

[57] ABSTRACT

The document of value is provided with a safety design extending on one portion or the whole of its surface. The entire surface of the safety design consists of juxtaposed groups of segments of raised parallel lines of two different heights forming high reliefs and low reliefs portions. The segments of two adjacent groups are parallel to two predetermined directions, preferably substantially perpendicular. The assembly of segments parallel to one of the directions and consisting of high reliefs on the whole or part of their length define a transitory image visible when the document is illuminated or observed parallel to a direction perpendicular to said segments and forming an acute angle with the plane of the document of value. A second transitory image is formed in a similar manner by high relief segments parallel to the other direction. The low raised segments or segment fractions constitute the background of the safety design. All the raised segments and the gaps left between the segments have preferably the same color.

5 Claims, 6 Drawing Figures

DOCUMENT OF VALUE

FIELD OF INVENTION

The present invention relates to a document of value comprising a safety design, notably a banknote or fiduciary currency covering part or the whole of the document and comprising a background and two transitory images.

PRIOR ART

For the purpose of preventing the issuing of false documents of value and more particularly of banknotes, various printing methods have been proposed and, in particular, documents of value have been provided with safety designs consisting of fine lines of different colors forming a complex image so that it is difficult to reproduce them by using photographic means. However, the development of reproduction techniques have made it possible for forgers to overcome, at least in certain cases, this difficulty. Another solution consisted in fabricating documents of value of which at least one fraction of the surface comprises raised lines obtained by using the so-called intaglio method. On the basis of this method several modified versions have been proposed. More particularly, the obtaining of a transitory image made of parallel raised lines was proposed. According to a modified version, the transitory image is detectable only through a suitable transparent screen or by illuminating the document of value with a suitable light. In another case the color of the sides of the raised lines varies along their length or from one side to another so that when the banknote is observed from two different angles two different images appear according as one or the other side of the raised lines is concealed. Finally, in another case the raised lines have a uniform color contrasting with that of the paper (the gaps between the lines), so that the image formed by these raised lines appears only when the design is observed under a relatively flat acute angle and in a direction parallel to a plane normal to said lines, which in this case conceal the gaps between them and display a uniformly colored image. This image is difficult to detect when the design is observed in a direction normal to its plane, for the image is decomposed by the color contrast between the lines and the spaces between lines.

These solutions made it difficult if not impossible to manufacture forged documents of value because no photographic device is capable of making a three-dimensional reproduction. However, the first-mentioned variants are objectionable in that they entail the use of an additional device (screen, lens, special-light lamp, etc) for checking the authenticity and therefore make it almost impossible in the daily use of documents of value. As to the last two variants, they require a very high degree of precision when making transitory images in order to obtain a perfect color registration. Furthermore, the observation angle is relatively small, of the order of 15° to 20° with respect to the plane of the paper, so that checking a great number of documents constitutes a tedious task.

SUMMARY OF THE INVENTION

It is the object of the present invention to avoid these inconveniences by permitting the obtaining on the one hand of a safety design on a document of value by utilizing the intaglio method, without resorting to any color contrast and on the other hand the safety design can easily be detected by an unskilled person without resorting to auxiliary means such as lamp, screen, lenses, etc., and from a relatively wide angle.

The safety design according to the invention is characterized by the fact that the entire surface area of the safety design consists of juxtaposed groups of segments of parallel raised lines having two different heights, forming high and low reliefs, extending by turns in two predetermined different directions whereby the segments of one group are not parallel to those of an adjacent group, that the periphery of each group defines a plane geometrical figure which is the same for all the groups of segments parallel to the same direction and is completed by the peripheries of the adjacent groups for composing the design surface, that one portion of all the segments have said high relief on the whole or part of their length, that the first transitory image is formed by the high raised segments parallel to the first direction and pertaining to several groups, whereas the second transitory image is formed by the high raised segments parallel to the second direction and pertaining likewise to several groups, that at least one portion of the segments forming the two images pertain to adjacent groups, that an image appears when it is illuminated by light rays forming an acute angle with the plane of the design and parallel to a plane at least substantially normal to the direction to which the image-forming segments are parallel or when the design is seen from an acute angle and in a direction parallel to a plane at least substantially normal to the direction to which the image-forming image are parallel, that the segments or fractions thereof having said low relief, form with the gaps between said segments the background of said safety design.

The advantages of the invention are as follows: The safety design consists of raised segments of parallel lines forming juxtaposed groups which are easily obtained by means of intaglio imprints and without resorting to accurate adjustments for adhering to the color register, the assembly comprising the safety design, the raised segments and the gaps left between segments having the same color. The authenticity can be checked by any user either by illuminating the design with natural light or by using an ordinary electric lamp, or more simply by observing it from an acute angle in a direction parallel to a plane normal to the raised lines constituting one of the images. The second image appears when the document of value is rotated through an angle substantially equal to the angle formed between the two predetermined directions to which the segments of two adjacent groups are parallel, respectively.

The fact that an image appears when the design is illuminated from an acute angle and in a direction parallel to a plane at least substantially normal to the raised segments constituting the image is due to the fact that the segments, of which the height is greater than that of the segments constituting the background of the design, or rather the groups of segments, appear as having a darker color due to the shadow of the segments projected on one another. Also, apparently the density of the segments seems to increase when they are seen in a direction at right angles and from an acute angle with respect to their support. It is obvious that for obtaining these results it is only necessary that the illumination or observation angle be simply less than 90°.

When observing the paper at right angles to its plane no image whatsoever is seen, inasmuch as the groups comprising the segments forming the two images are, at least partially adjacent, so that in effect the images are partially mixed up.

According to a preferred embodiment, the two segment directions are perpendicular and the geometrical pattern determined by the periphery of one group of segments is a rectangle, notably a square.

BRIEF DESCRIPTION OF THE DRAWINGS

The invention will now be described more in detail with reference to the attached drawing.

DESCRIPTION OF THE PREFERRED EMBODIMENTS

Figure 1:
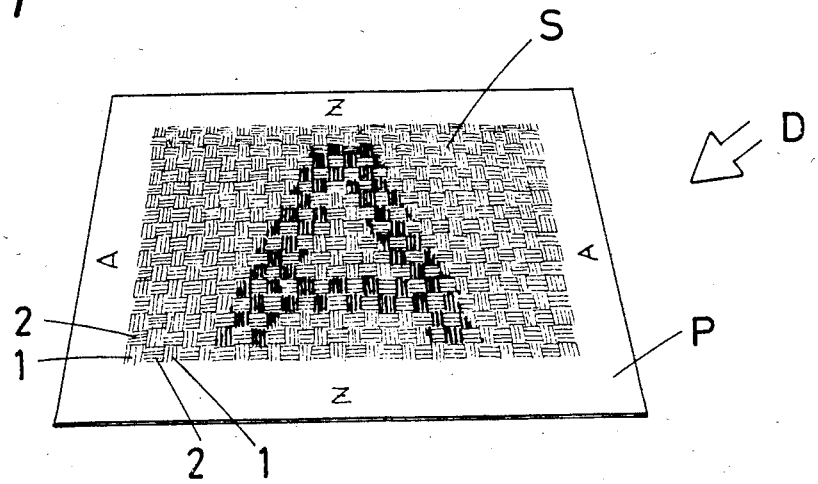
FIG. 1 is a perspective view of a safety imprint causing a first image to appear.
Figure 2:
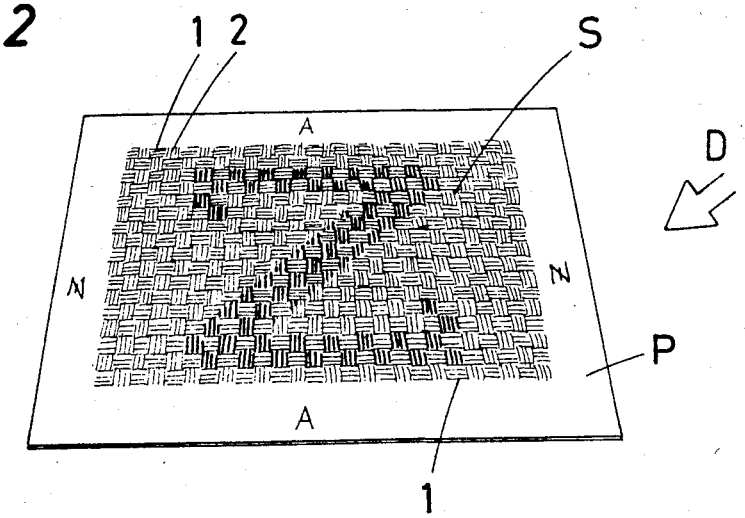
FIG. 2 is a view similar to that of FIG. 1, which causes a second image to appear.
Figure 6:
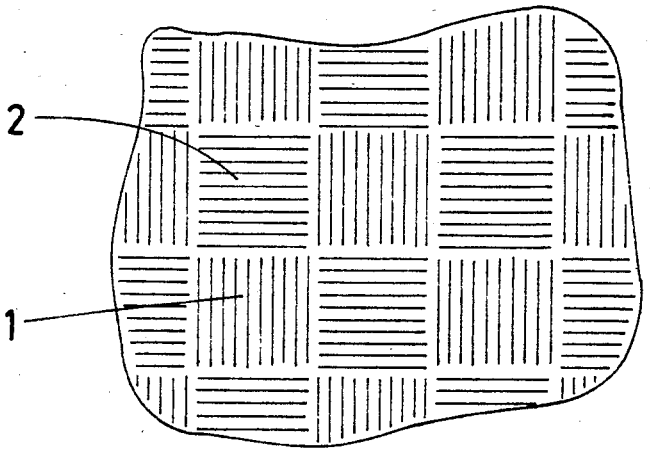
FIG. 6 is a substantially magnified plane view of one portion of a safety imprint.

The safety imprint S shown in FIGS. 1 and 2 of a document of value P consists of raised straight segments forming juxtaposed groups 1,2. FIG. 6 shows some of these groups on a large scale. The segments of two adjacent groups 1,2 are parallel to two perpendicular directions. The raised segments have a black appearance but actually the raised segments and the gap between any pair of adjacent segments have the same color. A shade may exist between the raised segments and the gaps between adjacent raised segments, if the color of the paper support contrasts with the color of the ink used for printing the safety design, due to the difference in ink layer thickness between a raised segment and the gap left between two adjacent segments, as will be explained presently.

In general and contingent on the above remark, the safety design, when seen in a direction normal to its plane, appears as having a uniform color. The patterns bounded by the segment ends and the endmost segments of each group 1,2 form a square. However, any other pattern may be obtained, provided that the peripheries of two adjacent groups conjugate so that the entire background of the design be covered continuously.

When the design is illuminated or observed at an acute angle in a direction parallel to the arrow D, which is at least substantially normal to one of the directions to which the segments are parallel, a first image is caused to appear in the form of an "A", this image being formed by raised segments and segments fractions of a height greater than that of the other segments, respectively segment fractions, and perpendicular to direction D. If the document of value P is rotated through an angle of 90° in its plane, a second image appears, in this case a "Z" (the small characters A and Z on the periphery of the design being only reference marks added for providing a clearer understanding of the Figures). This second image is formed in the same manner as the preceding one, but by segments perpendicular to the segments of the preceding image.

Of course, if the two predetermined directions are not perpendicular, the document of value P must be rotated through an angle equal to the angle formed by these two directions.

Figure 3:
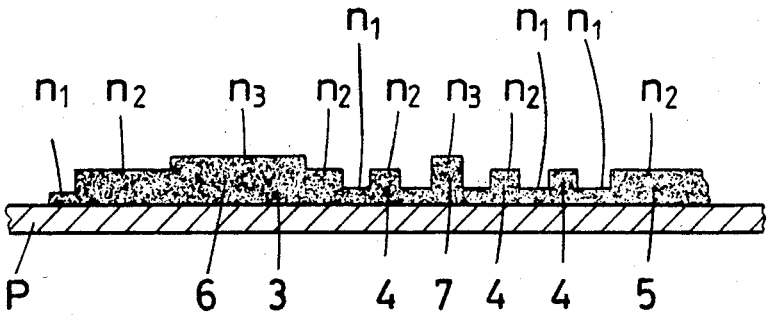
FIG. 3 is a sectional view of an enlarged portion of a document of value showing the various raised elements.

FIG. 3 shows, in section, the various elements of the safety design. The document of value P is covered with an ink layer having three different levels. The lowest level $n_1$ is the level existing between the raised segments. Then there is level $n_2$ which is the level of the low raised segments. The background of the safety design is formed by levels $n_1$ and $n_2$. Level $n_3$ is the level of the high raised segments or segment fractions constituting one or the other of the transitory images.

By way of example, segments 4 and 5 pertaining to two adjacent groups are low raised segments or segment fractions and pertain therefore to the background of the safety design. Segments 4 are normal to the plane of FIG. 3 and segment 5 is parallel to this plane. Segment 7 parallel to segments 4 is a segment of which the upper portion extending throughout its length or one fraction thereof at the highest level $n_3$ and is used in the composition of one of the transitory images. The upper portion of segment 6, which is aligned with segment 5, is at two levels. A first portion is at level $n_3$ and therefore at the high level, and is used in the composition of the other transitory image and two other portions are at level $n_2$, therefore at the low raised level, and are part of the design background.

Figure 4:
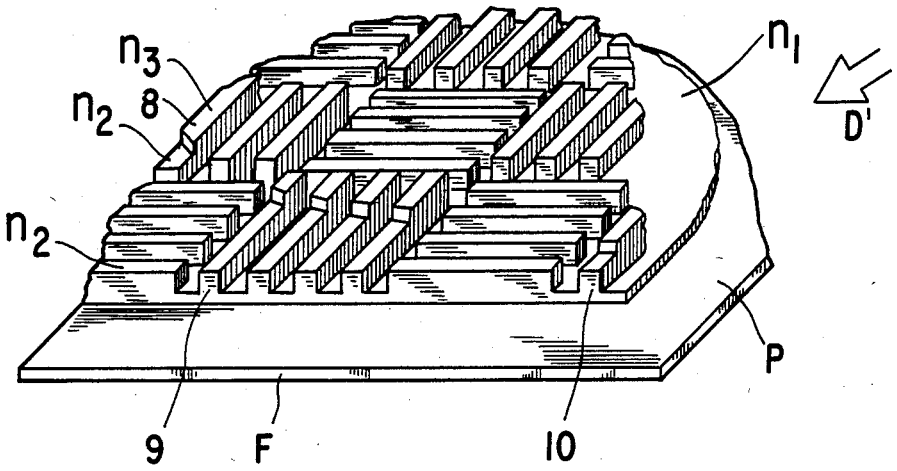
FIG. 4 is a substantially magnified perspective view of one portion of a safety imprint.

The detail shown in enlarged perspective in FIG. 4 also explains the formation of the safety design. All the groups with segments parallel to the front edge F of the document of value P are part of the design background, and the segments perpendicular to said edge F, which pertain to the other groups, constitute a transitory image. Segment 8 comprises an upper portion which is at level $n_3$ and another portion which is at level $n_2$. The segments pertaining to the same group as segment 8 have likewise their upper portions at level $n_3$. Segment 9 and those of its groups have also two different levels extending on unequal lengths, the same applying to segment 10. The other segments illustrated, parallel to segment 10, are at level $n_3$. All the segments or segment portions of level $n_3$ assist in forming an image which can be seen when illuminating the design or when the latter is seen in a direction parallel to D'.

Figure 5:
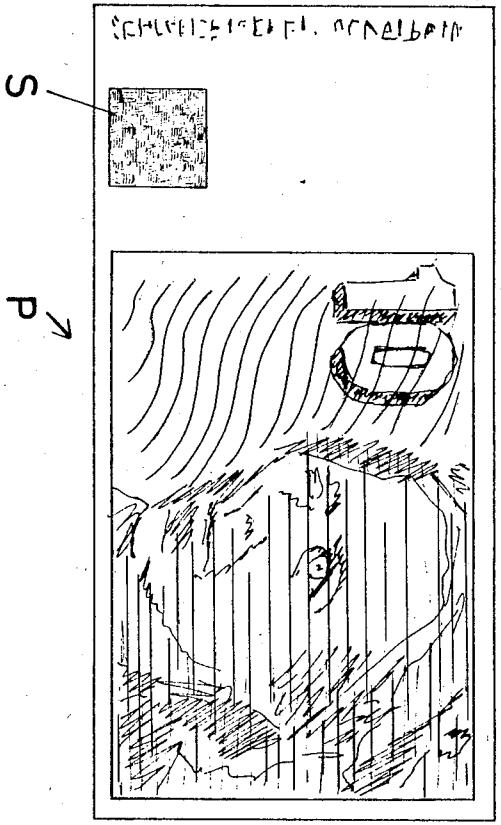
FIG. 5 illustrates a banknote with the safety imprint.

The safety design may occupy either one fraction of a document of value, as shown in FIG. 5, or the entire surface of the paper.

The Applicant has printed a safety design on a banknote according to the intaglio method by using the following magnitudes for the three levels with respect to the surface of the document of value:

$n_1 = 0.03$ mm $n_2 = 0.07$ mm $n_3 = 0.14$ mm.

What is claimed is:

1. A document of value having a safety design extending on one portion or the whole of the document, which comprises a background and at least two transitory images, wherein the entire surface of said safety design consists of juxtaposed groups of parallel raised segment lines having two different heights forming high and low raised lines extending alternately in two predetermined different directions, so that the segments of one group are not parallel to those of an adjacent group, the periphery of each group defining a plane geometrical pattern which is the same for all the groups of segments parallel to the same direction and is completed by the peripheries of the adjacent groups for forming the design surface, one portion of all the segments forming said high raised lines on the whole or part of their length, said first transitory image being formed by the high raised lines made of segments parallel to said first direction and pertaining to several groups, whereas said second transitory image is formed by the high raised lines consisting of segments parallel to said second direction and pertaining likewise to several groups, at least one portion of the segments forming said first and second image pertaining to adjacent groups, an image becoming visible when it is illuminated by light rays forming an acute angle with the plane of the design and parallel to a plane at least substantially perpendicular to the direction in which the image forming segments are parallel or when the design is observed from an acute angle and in a direction parallel to a plane at least substantially perpendicular to the direction to which the image forming segments are parallel, said segments or segment portions which pertain to the low raised lines forming with the gaps left between said segments the background of the design of said document of value.

2. Document of value according to claim 1, wherein the plane geometrical patterns defined by the peripheries of the groups of segments are rectangles, notably squares.

3. Document of value according to claim 1, wherein the two predetermined directions are perpendicular to each other.

4. Document of value according to claim 1, wherein all the safety design, raised segments and gaps between segments have the same color.

5. The document of value according to claim 1 wherein the lines of each group are oriented in one of said two directions and the lines of all the corresponding adjacent groups are oriented in the other of said two directions.

* * * * *